US006161628A

United States Patent [19]

Liu

[11] Patent Number: 6,161,628

[45] Date of Patent: Dec. 19, 2000

[54] PNEUMATIC TOOL

[75] Inventor: I-Yueh Liu, Nantou, Taiwan

[73] Assignee: Q.C. Witness Int. Co., Ltd., Taipei, Taiwan

[21] Appl. No.: 09/559,735

[22] Filed: Apr. 28, 2000

[51] Int. Cl.[7] ..... B25D 17/10

[52] U.S. Cl. ..... 173/168; 173/169; 173/114; 173/206

[58] Field of Search ..... 173/168, 169, 173/170, 200, 128, 114, 206

[56] References Cited

U.S. PATENT DOCUMENTS

| | | | |
|---|---|---|---|
| 3,635,605 | 1/1975 | Hall et al. | 173/169 |
| 5,251,367 | 10/1993 | Ward et al. | 173/168 |
| 5,417,294 | 5/1995 | Suher | 173/206 |
| 5,901,794 | 5/1999 | Schoeps et al. | 173/169 |
| 5,913,370 | 6/1999 | Chapelle et al. | 173/170 |

*Primary Examiner*—Scott A. Smith
*Attorney, Agent, or Firm*—Rabin & Champagne, P.C.

[57] ABSTRACT

A pneumatic tool is disclosed. The pneumatic tool has a hollow housing with a handle extending therefrom, the handle having a chamber defined therein and an air passage communicating with the housing, an actuating mechanism mounted in the housing to actuate a tool shank and a cap securely attached to said handle to cover the chamber so as to form an oil reservoir in the handle. The pneumatic tool further has a control member mounted in the actuating mechanism to control the opening and closing of a discharge passage formed in the actuating mechanism. The disclosed pneumatic tool can limit the size of the pneumatic tool and let the air completely flow out so as to improve the convenience and operational effectiveness of the pneumatic tool.

13 Claims, 10 Drawing Sheets

PNEUMATIC TOOL

BACKGROUND OF THE INVENTION

1. Field of the Invention

The present invention relates to a pneumatic tool, and more particularly to a pneumatic tool with a lubricating oil reservoir.

2. Description of Related Art

A pneumatic tool like a pneumatic chisel in accordance with the prior art shown in FIG. 10 comprises a hollow housing (60) with an actuating mechanism (70) and a handle (62) extending from the hollow housing (60) to connect with a high-pressure air source with a high-pressure air connector (64). The actuating mechanism (70) includes a reciprocating valve (72) to control the direction of the air flow to propel an piston (76) to slide along a cylinder (74) forwards and backwards. Consequently, the high-pressure air can be directed into the hollow housing (60) through the high-pressure air connector (64) and the handle (62), and the actuating mechanism (70) will be actuated to impact a tool shank (78) for hammering or chiseling. In addition, a lubricating oil tank (80) is mounted on the high-pressure air connector (64) to provide lubrication for the actuating mechanism (70) when the pneumatic tool is operated.

However, because the conventional oil tank (80) is attached to the high-pressure air connector (64) and connects with the high-pressure air hose, the structure of the tank (80) is complex and the size of the pneumatic tool is large, which impacts both the manufacture and operation of the tool. In addition, at least one exhaust port (742) is formed in the cylinder (74) to release the air that propels the piston (76) along the cylinder (74) to overcome a high back pressure when the piston (76) moves in the opposite direction. However, all of the high-pressure air cannot be exhausted from the cylinder (74) in the conventional pneumatic tool. The air still remaining in the cylinder (74) will keep the piston (76) from returning to the initial point, thus shortening the stroke of the piston (76) and decreasing the power delivered to the tool shank.

To overcome the shortcomings, the present invention tends to provide an improved pneumatic tool to mitigate or obviate the aforementioned problems.

SUMMARY OF THE INVENTION

The main objective of the invention is to provide a pneumatic tool having a hollow housing with a handle extending therefrom and an actuating mechanism mounted in the hollow housing. A control member is mounted in the actuating mechanism to control the opening and closing of a discharge passage formed in the actuating mechanism, such that all the air can flow out and the stroke of the actuating mechanism will increase.

Another objective of the invention is to provide a pneumatic tool having a chamber defined in the handle and a cap mounted on the handle to cover the chamber so as to integrally form an oil reservoir in the handle. This keeps the size of the pneumatic tool from being large and improves the convenience of operation.

Other objects, advantages and novel features of the invention will become more apparent from the following detailed description when taken in conjunction with the accompanying drawings.

DETAILED DESCRIPTION OF PREFERRED EMBODIMENT

Figure 1:
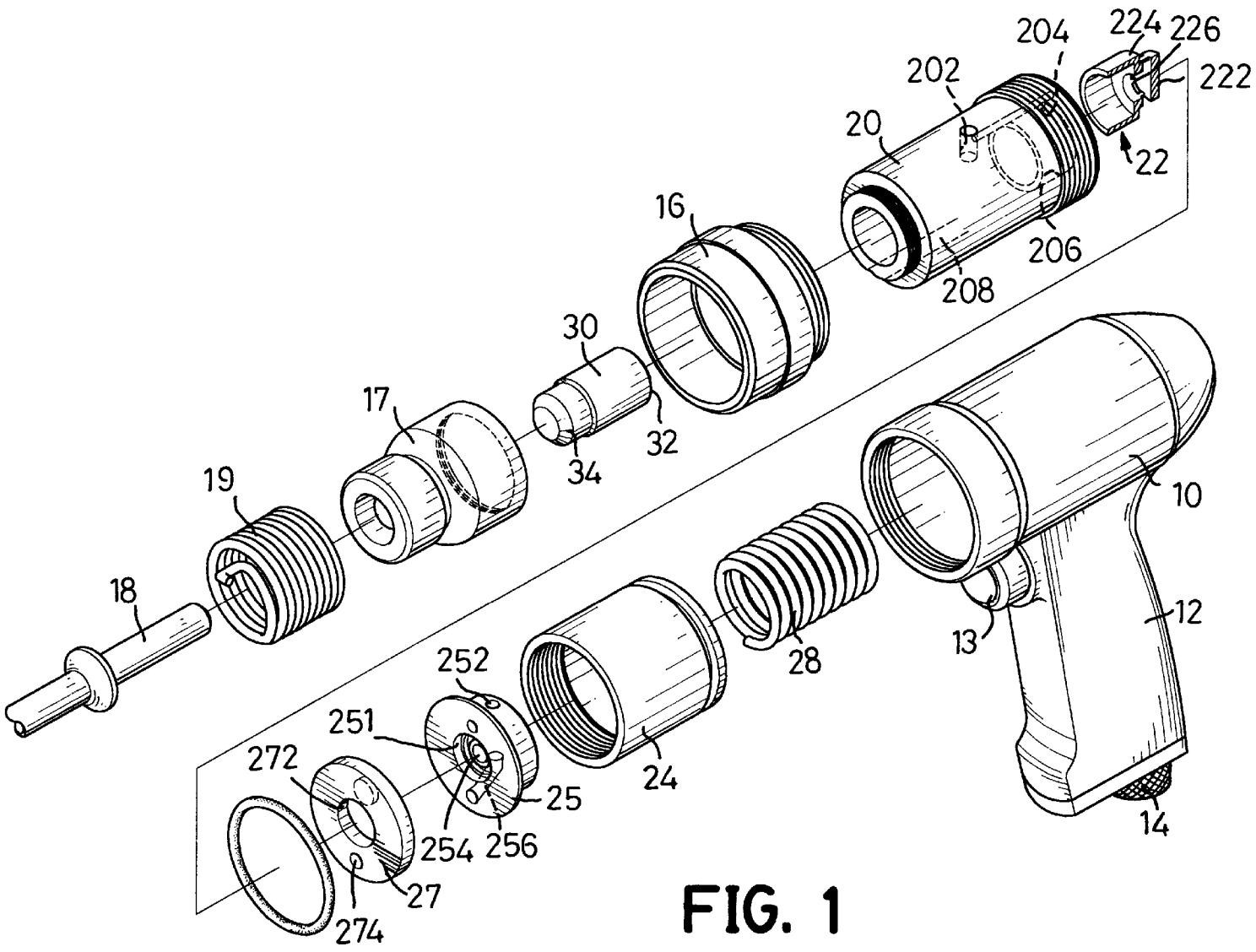
FIG. 1 is a partially exploded perspective view of a pneumatic tool in accordance with the present invention.
Figure 2:
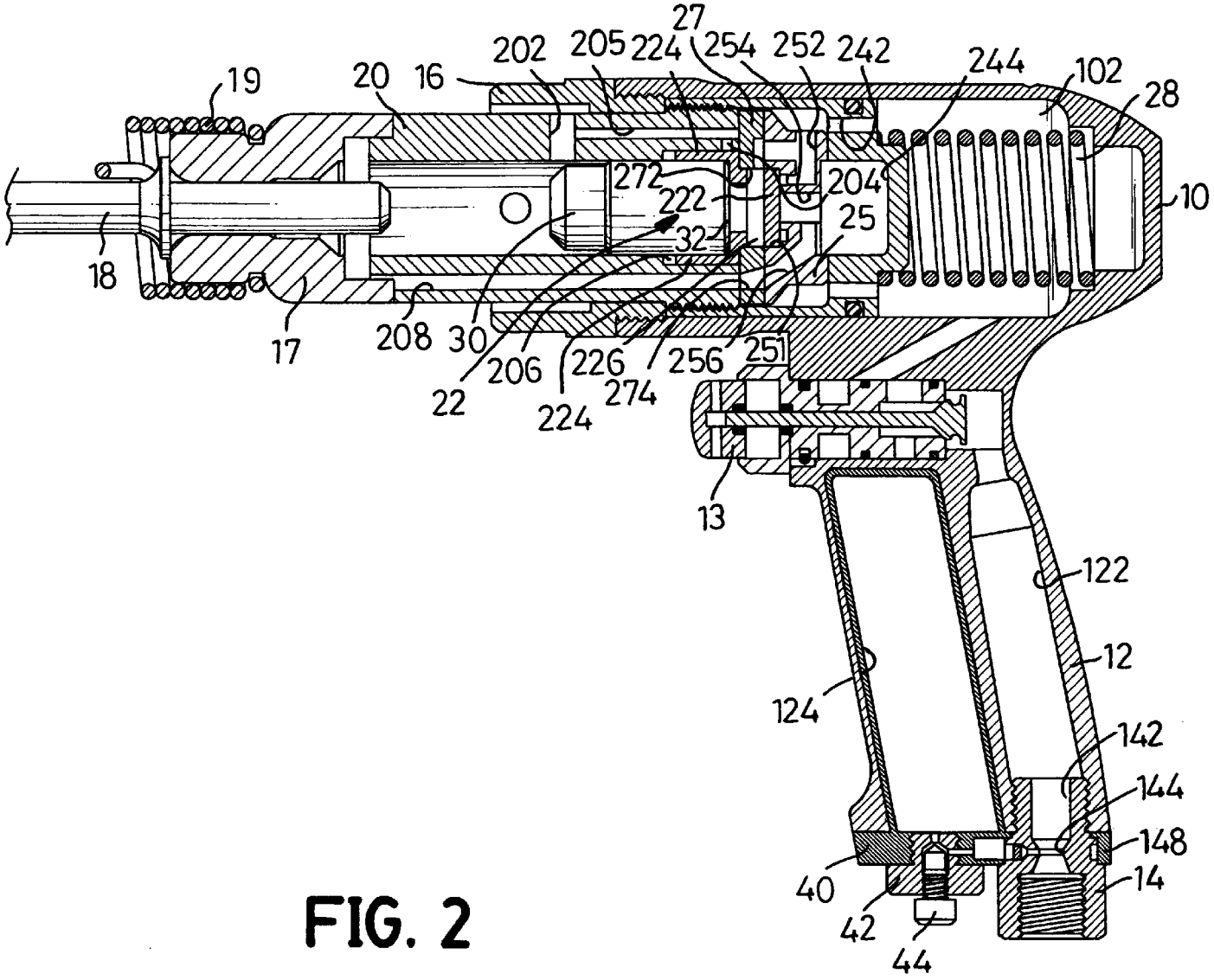
FIG. 2 is a side cross sectional plan view of the pneumatic tool in FIG. 1.

Referring to FIGS. 1 and 2, a pneumatic tool in accordance with the present invention comprises a hollow housing (10), a handle (12) integrally extending from the housing (10), an actuating mechanism mounted in the housing (10) and a tool shank (18) with a spring (19).

The housing (10) has an inner space to receive the actuating mechanism.

The handle (12) has an air passage (122) capable of communicating with the inner space of the housing (10). A high-pressure air connector (14) with a passage (142) extending therethrough is detachably mounted in the external opening of the air passage (122) to allow the high-pressure air to enter the air passage (122) and the housing (10). A trigger (13) is mounted between the housing (10) and the handle (12) to control the air stream into the housing (10).

The actuating mechanism includes a cylinder (20), a piston (30) slidably received in the cylinder (20) and a reciprocating valve mounted on one end of the cylinder (20) to control the direction of the air stream. The cylinder (20) has a feedback passage (208) connecting the end of the cylinder (20) with the reciprocating valve. A tube (206) is defined in the inner periphery of the end of the cylinder (20) with the reciprocating valve mounted thereon. The cylinder (20) further has at least one discharge port (202) defined thereon and a discharge passage (204) of the discharge port (202) connecting to the tube (206). The piston (30) has a first end (32) facing the reciprocating valve and a second end (34) facing the tool shank (18).

The reciprocating valve comprises a valve body (25), a cover disk (27) located between the cylinder (20) and the valve body (25) and a control member (22). The valve body (25) has a cavity (251) defined in the side facing the cover disk (27) and a central hole (254) defined in the face of the cavity (251). An inlet hole (252) and a feedback hole (256) are defined in the valve body (25) connecting to the cavity (251) and the central hole (254) respectively. The cover disk (27) has a central hole (272) and a feedback hole (274) aligning with the cavity (251) and the feedback hole (256) of the valve body (25) respectively. The control member (22) has a sliding collar (224) with a seal disk (222)

integrally extending from one end and an opening defined in the other end. The sliding collar (224) is slidably received in the tube (206) of the cylinder (20), and the seal disk (222) extends through the central hole (272) of the cover disk (27) and is received in the cavity (251) of the valve body (25). At least one inlet (226) connecting to the opening of the sliding collar (224) is defined on the control member (22) between the cover disk (222) and the sliding collar (224).

A cylinder cover (24) is mounted on the end of the cylinder (20) with the reciprocating valve received therein. The cylinder cover (24) has at least one bore (242) defined thereon. A cap (17) is mounted on the other end of the cylinder (20) with a tool shank (18) extending therethrough and a spring (19) mounted on one end thereof. A positioning collar (16) is threadingly mounted onto the housing (10) with one end abutting one end of the cylinder cover (24) so as to fixedly position and limit the cylinder cover (24) be received in the housing (10). Due to the positioning collar (16) and the cylinder cover (24), the cylinder (20) is fixedly mounted onto and received in the hollow housing (10).

Figure 3:
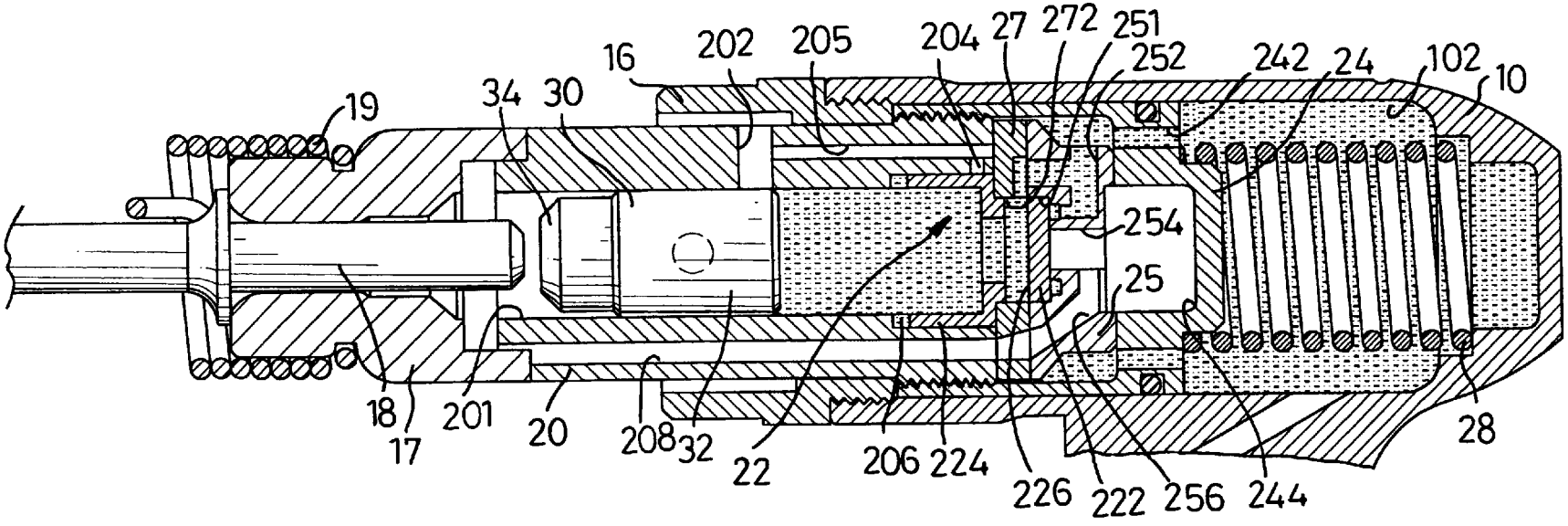
FIG. 3 is a cross sectional side plan view of the pneumatic tool in FIG. 1 with the piston being pushed along the cylinder in one direction.

Referring to FIGS. 1–3, when the user presses the trigger (13), the high-pressure air will be released into the housing (10) through the high-pressure air connector (14) and the air passage (122) of the handle (12). The air will pass through the bore (242) of the cylinder cover (24) and the inlet hole (252) of the valve body (25) and flow into the cavity (251). The seal disk (222) of the control member (22) will be pushed to abut the central hole (254) of the valve body (25) to seal it by the pressure between the cylinder (20) and the central hole (254) of the valve body (25). In the mean time, the sliding collar (224) will align with the discharge passage (204) of the cylinder (20) and seal it. Consequently, the air can pass through the central hole (272) of the cover disk (27) and the inlets (226) of the control member (22), and push the first end (32) of the piston (30) to slide along the cylinder (20) and strike the tool shank (18).

Figure 4:
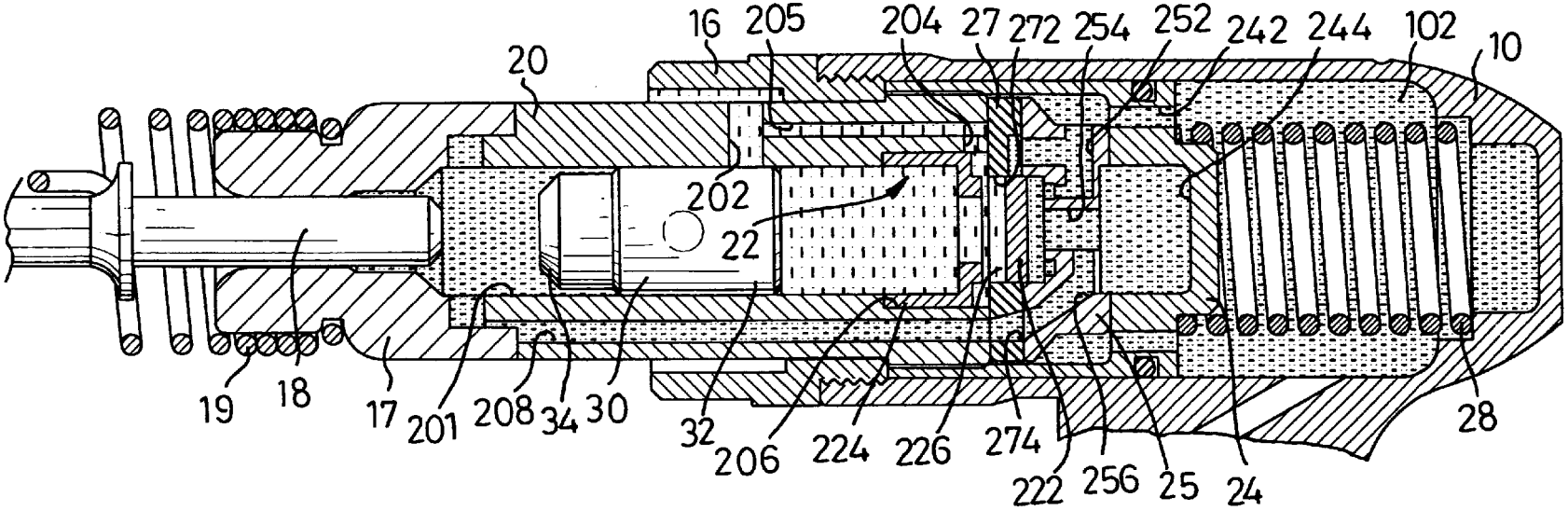
FIG. 4 is a cross sectional side plan view of the pneumatic tool in FIG. 1 with the piston being returned along the cylinder in the opposite direction.

Referring to FIGS. 1 and 4, because the piston (30) has passed the discharge ports (202) as the piston (30) strikes the tool shank (18), the air on the first end (32) of the piston (30) will flow out of the discharge ports (202) of the cylinder (20). The pressure of the air on the first end (32) of the piston (30) will decrease immediately, and will increase on the second end (34). Such that, the seal disk (222) of the control member (22) will be pushed away from the central hole (254) of the valve body (25) to open it and seal the central hole (272) of the cover disk (27). The sliding collar (224) will slide along the tube (206) simultaneously, and the inlet (226) of the control member (22) will align with the discharge passage (204) of the cylinder (20). Therefore, the high-pressure air will pass through the central hole (254) and the feedback hole (256) of the valve body (25), the feedback hole (274) of the cover disk (27) and the feedback passage (208) of the cylinder (20) into the cylinder (20). The air pushes the second end (34) of the piston (30) to slide it along the cylinder (20) back toward the tube (208). When the piston (30) passes the discharge ports (202) of the cylinder (20), the air on the second end (34) of the piston (30) will flow out of the discharge ports (202) and that on the first end (32) will be pressed by the piston (30). At that time, the air on the first end (32) of the piston (30) will pass through the opening in the sliding collar (222), the control member (20) inlet (226), the cylinder (20) discharge passage (204) and the discharge port (202). Therefore, there is no drag when the piston (30) moves backward, and it will fully return to the initial point. This maintains the length of the stroke and the power of the piston (30) for striking the tool shank (18).

Referring to FIGS. 2 and 4, the cylinder cover (24) has a chamber (244) connecting to the central hole (254) of the valve body (25). By such an arrangement, pressure remains in the chamber (244), and the seal disk (222) of the control member (22) will not immediately move to seal the central hole (254) of the valve body (25) when the piston (30) slides backward along the cylinder (20). A buffer chamber (102) is formed in the housing (10), and a shock absorber (28) such as a spring is mounted in the buffer chamber (102) between the cylinder cover (24) and the housing (10). This provides a damping force when the piston (30) comes back to the initial point and strikes the control member (22) and the reciprocating valve. Furthermore, because there is high-pressure air in the buffer chamber (102), the pressure between the housing (10) and the cylinder (20) will increase. Therefore, the force applied to the piston (30) in the power stroke will increase.

Figure 5:
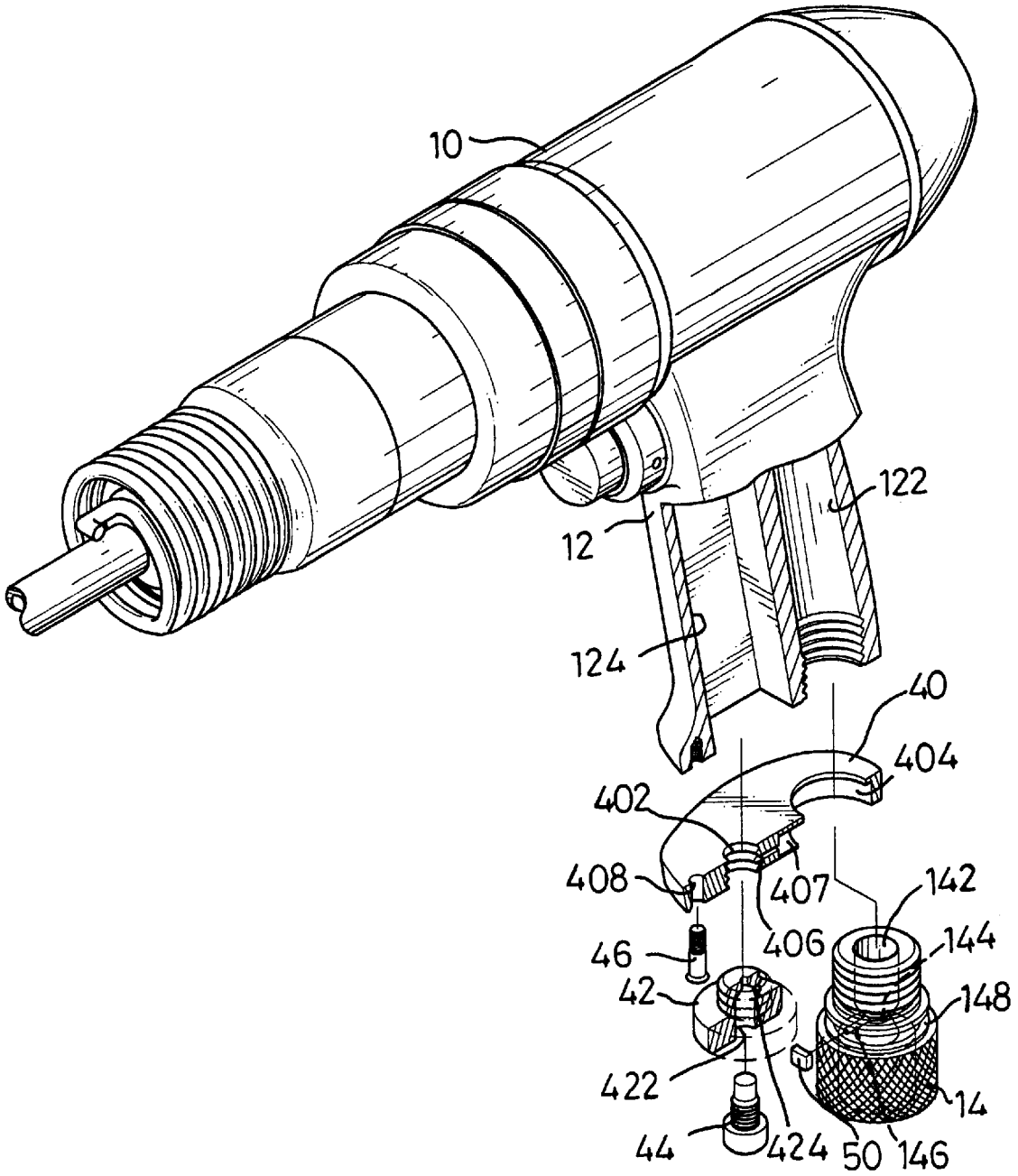
FIG. 5 is a partial exploded perspective view in partial section of the pneumatic tool in FIG. 1.
Figure 6:
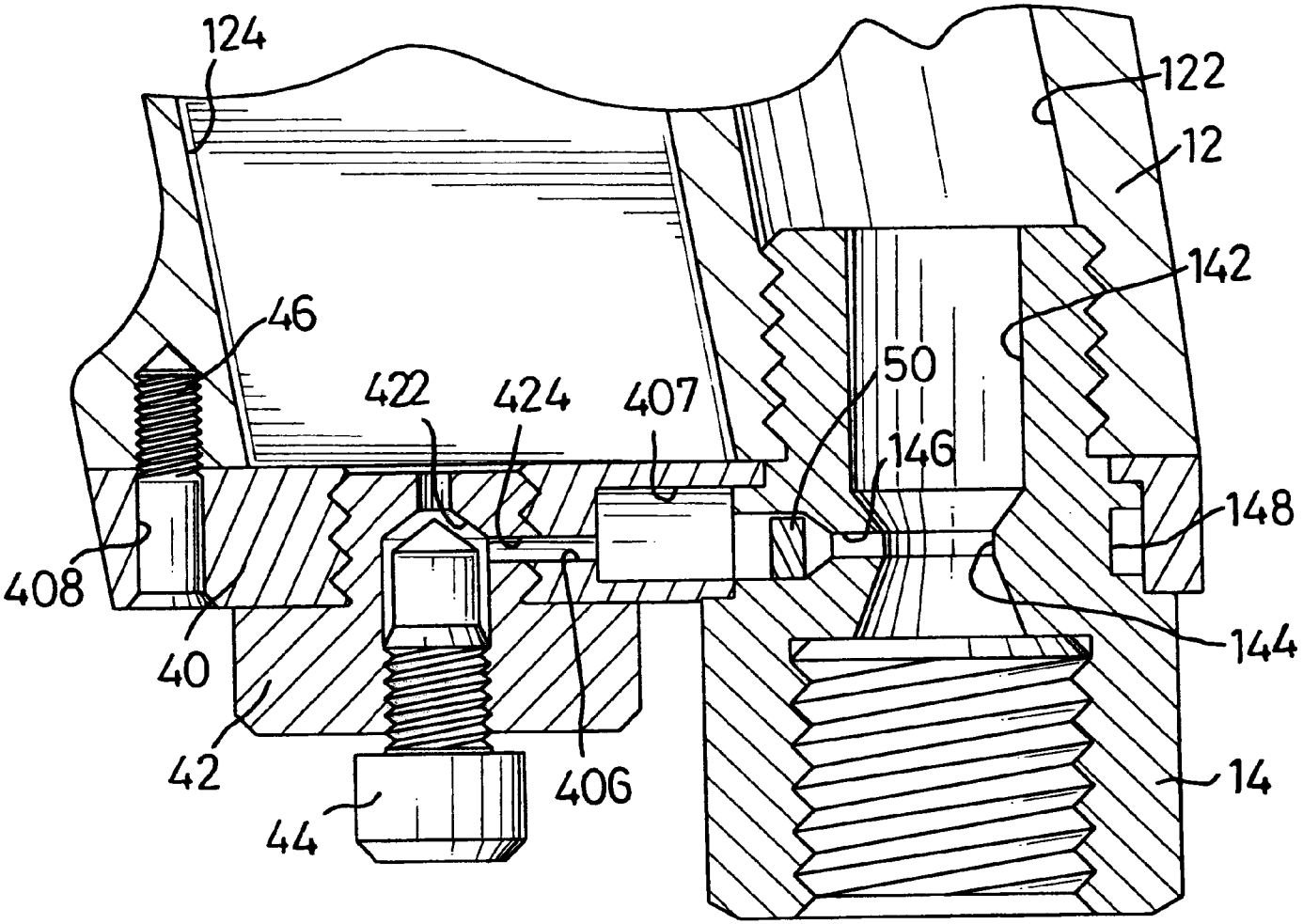
FIG. 6 is a partial plan view in partial section of the pneumatic tool in FIG. 5.

Referring to FIGS. 5 and 6, a chamber (124) is formed in the handle (12), and a cap (40) is mounted on the handle (12) to cover the air passage (122) and the chamber (124). The chamber (124) closed by the cap (40) forms an oil reservoir for lubricating oil. A through hole (404) is formed in the cap (40) to allow the high-pressure air connector (14) to pass through. A bore (408) is formed in the cap (40) for a bolt (46) to screw into the handle (12) to securely attach the cap (40). A threaded hole (402) connecting to the chamber (124) is formed in the cap (40). A valve base (42) with a thread portion is screwed onto the threaded hole (402). The valve base (42) has a valve hole (422) connected to the chamber (124) into which an oil valve (44) is screwed and a hole (424) connected to the valve hole (422). The cap (40) has a passage (406) defined between the threaded hole (402) and the through hole (404). An orifice (144) is formed in the passage (142) of the high-pressure air connector (14). A recess (148) connecting to the passage (406) of the cap (40) is formed on the high-pressure air connector (14). An inlet (146) with a small diameter connecting to the orifice (144) is defined on the face of the recess (148) of the high-pressure air connector (14).

The lubricating oil in the chamber (124) will pass through the hole (424) in the valve body (42), the valve hole (422,) the passage (406) in the cap (40), the recess (148) and the inlet (146) of the high-pressure air connector (14). When there is no air flowing through the passage (142), the lubricating oil will not flow into the passage (142) of the high-pressure air connector (40) due to the surface tension of the oil. When the high-pressure air passes through the passage (142) of the high-pressure air connector (14), the Bernoulli effect draws the oil through the passage (406) in the cap (40) into the high-pressure air connector (14) passage (142) where it mixes with the air. The oil vapor lubricates the actuating mechanism mounted in the housing (10) when the air passes through the actuating mechanism. Because the oil reservoir is integrally formed in the handle (12), the size of the pneumatic tool will not enlarge. This improves the convenience of the pneumatic tool.

In addition, a buffer area (407) with a diameter larger than that of passage (406) of the cap (40) is defined therein, and a block (50) aligning with the inlet (146) of the high-pressure air connector (14) is mounted in the recess (148). The buffer area (407) can provide a buffer and containing effect to the oil flow, and the block (50) can allow very small amount of oil to pass into the inlet (146). This keeps the oil from being used up in a short time.

Figure 7:
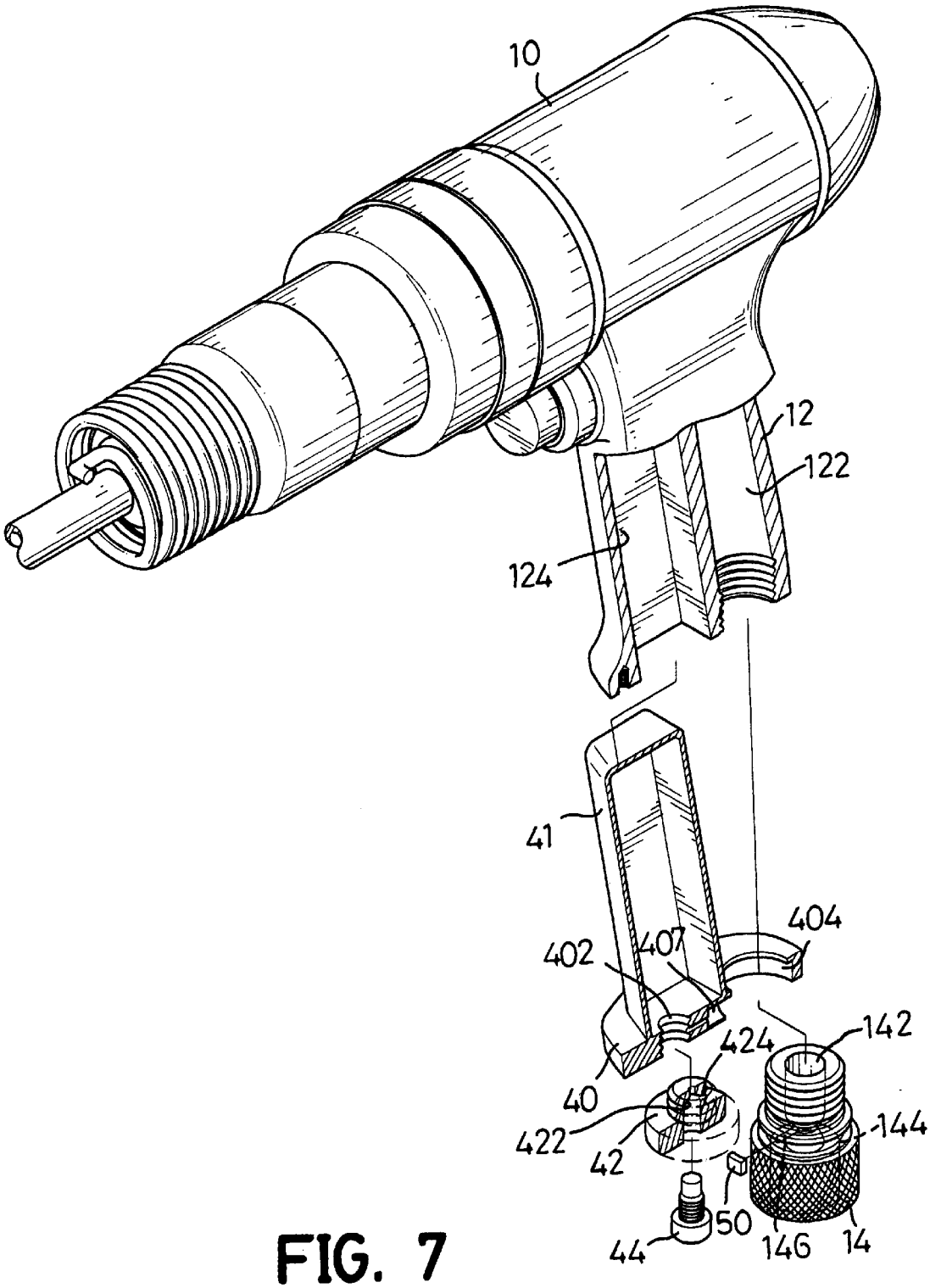
FIG. 7 is a partial exploded perspective view of another embodiment of the pneumatic in accordance with the present invention.

In another embodiment, referring to the FIG. 7, a container (41) is integrally formed on the cap (40) for the lubricating oil. When the cap (40) is mounted on the handle (12), the container (41) is inserted into the chamber (124) of the handle (12) like a clip.

Figure 8:
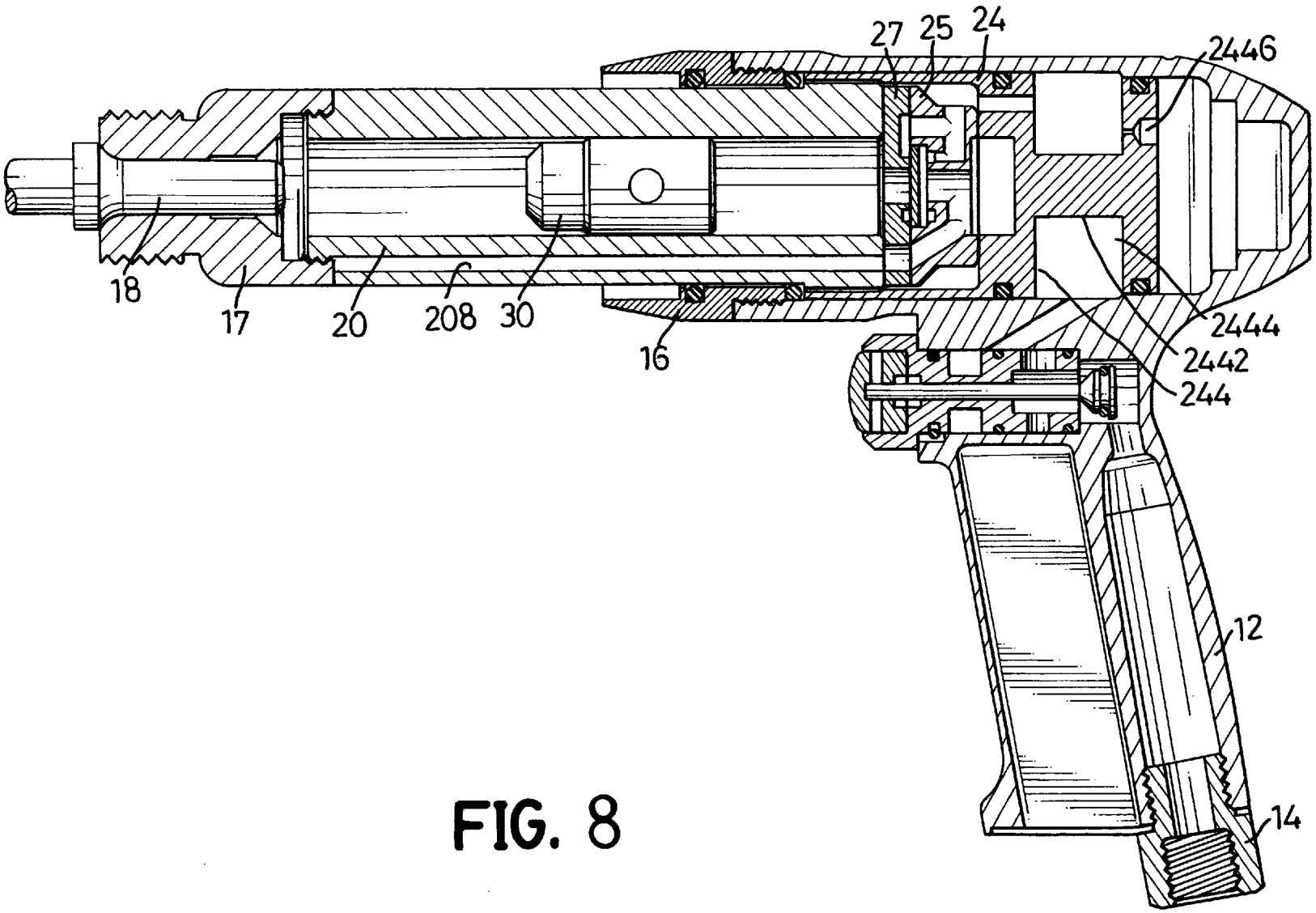
FIG. 8 is side cross sectional plan view of another embodiment in accordance with the present invention.

With reference to the FIG. 8, another embodiment in accordance with the present invention is similar to the embodiment as shown in FIG. 2, except that, the chamber (244) was divided by a rib (2442) extends therethrough to form a circular accessory chambers (2444) and a through hole (2446) is defined on an accessory chamber (2446) so that the air may flow therethrough to provide buffering effects.

Figure 9:
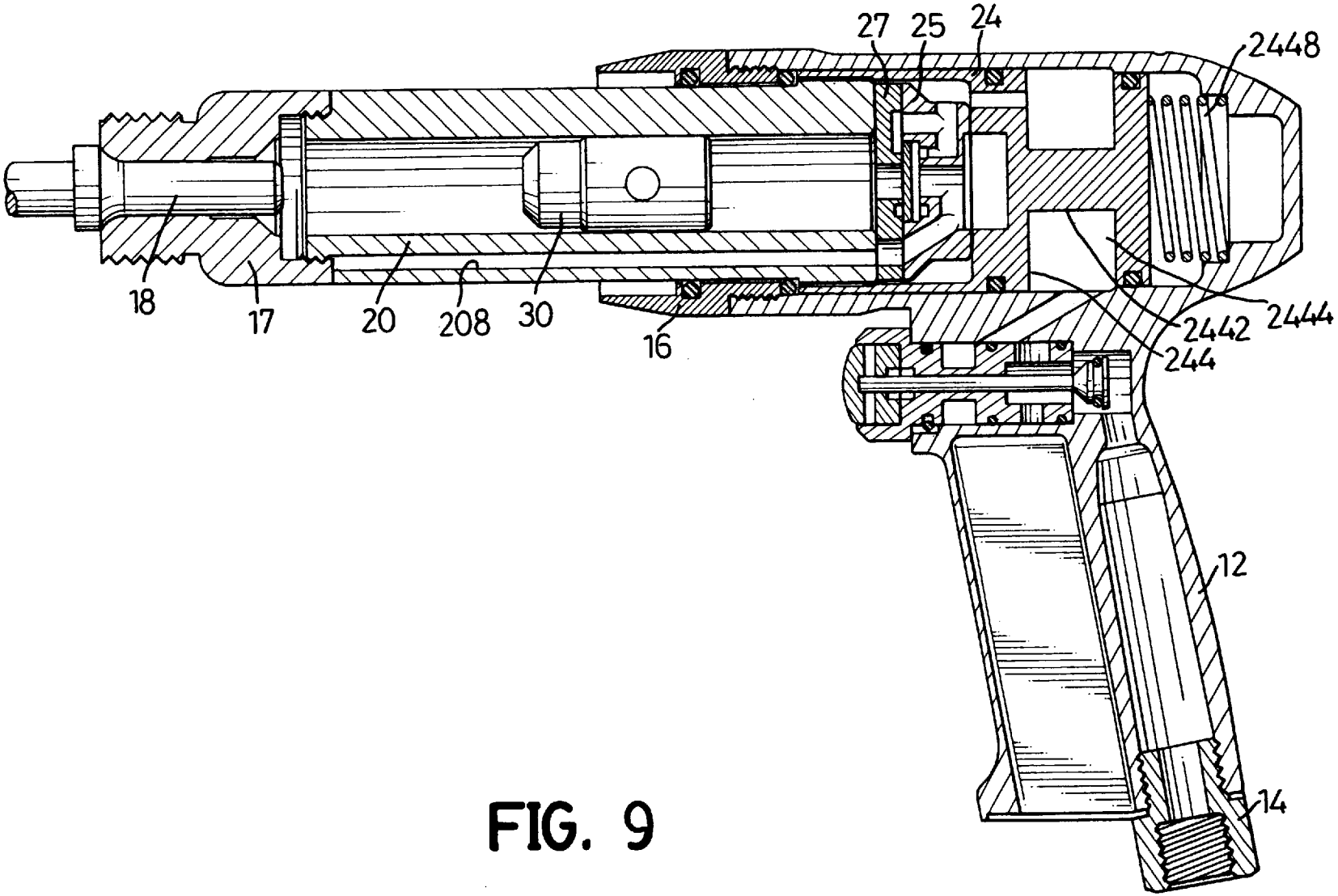
FIG. 9 is side cross sectional plan view of another embodiment in accordance with the present invention.
Figure 10:
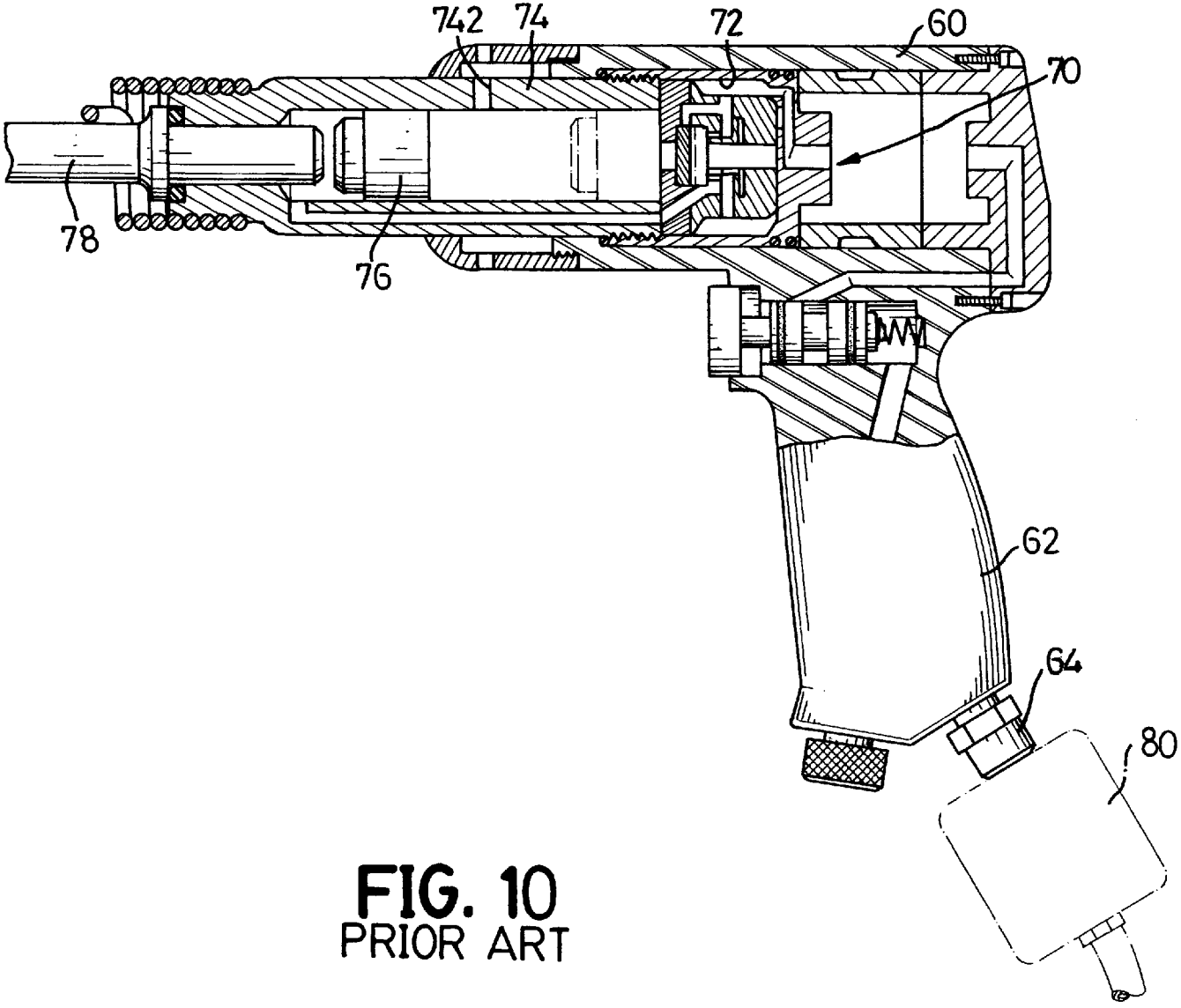
FIG. 10 PRIOR ART
FIG. 10 is a side plan view in partial cross section of a pneumatic tool in accordance with the prior art.

With reference to FIG. 9, another embodiment in accordance with the present invention is similar to that of FIG. 8, except that the through hole (2446) is replaced by a spring (2448) located between the bottoms of the chamber (244) and the pneumatic tool to provide the buffering effects.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pneumatic tool comprising:

a hollow housing with a handle extending therefrom, said handle having an air passage defined therein to communicate with said housing;

a high-pressure air connector detachably fit into one end of said air passage of said handle;

a cylinder cover received in the housing;

a cylinder mounted and partially received in the cylinder cover, and having a feedback passage extending from one end thereof, a tube defined in an inner periphery of the other end thereof, at least one discharge port connecting to the inside of said cylinder and a discharge passage defined between said tube and said at least one of discharge port;

a piston slidably received in said cylinder;

a positioning collar with one end mounted on the housing to abut the cylinder cover to fixedly position the cylinder;

a tool shank with one end extending into the end of the cylinder from which said feedback passage extends;

a reciprocating valve received in the cylinder cover and including a valve body with a cavity defined in one face thereof which faces said cylinder, a central hole defined in the face of said cavity, a feedback hole connecting to said central hole and an inlet hole connecting to said cavity;

a cover disk located between said cylinder and said valve body, and having a central hole communicating the cavity of the valve body with said cylinder and a feedback hole communicating said feedback passage of said cylinder with the feedback hole of the valve body; and a control member including a sliding collar slidably received in said tube of the cylinder, a seal disk extending through said central hole of said cover disk and slidably received in said cavity of said valve body and at least one inlet connecting to said sliding collar.

2. The pneumatic tool as claimed in claim 1, wherein said cylinder cover further having a chamber defined therein to communicate with said central hole of said valve body.

3. The pneumatic tool as claimed in claim 1, wherein a buffer chamber is further defined in said housing to receive said cylinder cover.

4. The pneumatic tool as claimed in claim 3 further comprising a shock absorber located between said housing and said cylinder cover.

5. A pneumatic tool comprising:

a hollow housing with a handle extending therefrom, said handle having an air passage defined therein to communicate with said housing and a chamber integrally formed therein;

a high-pressure air connector detachably fit into one end of said air passage of said handle;

a cylinder cover received in the housing;

a cylinder mounted and partially received in the cylinder cover, and having a feedback passage extending from one end thereof, a tube defined in an inner periphery of the other end thereof, at least one discharge port connecting to the inside of said cylinder and a discharge passage defined between said tube and said at least one of discharge port;

a piston slidably received in said cylinder;

a positioning collar with one end mounted on and received in the housing to abut the cylinder cover to fixedly position the cylinder;

a tool shank with one end extending into the end of the cylinder from which said feedback passage extends;

a reciprocating valve received in the cylinder cover and including a valve body with a cavity defined in one face thereof which faces said cylinder, a central hole defined in the face of said cavity, a feedback hole connecting to said central hole and an inlet hole connecting to said cavity;

a cover disk located between said cylinder and said valve body, and having a central hole communicating the cavity of the valve body with said cylinder and a feedback hole communicating said feedback passage of said cylinder with the feedback hole of the valve body;

a control member including a sliding collar slidably received in said tube of the cylinder, a seal disk extending through said central hole of said cover disk and slidably received in said cavity of said valve body and at least one inlet connecting to said sliding collar; and a cap securely attached to said handle to cover both said chamber and said air passage thereof, said cap having a through hole defined therein to align with said high-pressure air connector and allow said high-pressure air connector to pass through, a threaded hole receiving a valve base and said valve base having a valve hole defined thereon to receive an oil valve and a hole defined thereon to communicate said valve hole with said passage of said cap, and a passage defined therein to communicate said oil valve with said through hole of said cap.

6. The pneumatic tool as claimed in claim 5, wherein an orifice with a diameter smaller than that of said passage is defined in the inner face and connected to said inlet.

7. The pneumatic tool as claimed in claim 5, wherein a recess connecting to said inlet is defined on the outer periphery of said high-pressure air connector.

8. The pneumatic tool as claimed in claim 5 further comprising a block mounted on said high-pressure air connector and aligned with said inlet.

9. The pneumatic tool as claimed in claim 8, wherein a buffer area with a diameter larger that of said passage of said cap is defined therein between said passage and said through hole.

10. The pneumatic tool as claimed in claim 5 further comprising a block received in said recess of said high-pressure air connector and aligned with said inlet.

11. The pneumatic tool as claimed in claim 10, wherein a buffer area with a diameter larger that of said passage of said cap is defined between said passage and said through hole.

12. The pneumatic tool as claimed in claim 10, wherein the chamber was divided by a rib extends therethrough to form two accessory chambers and a through hole is defined on an accessory chamber.

13. The pneumatic tool as claimed in claim 12, wherein the chamber was divided by a rib extends therethrough to form two accessory chambers and a spring is further provided between two bottoms each of the chamber and the pneumatic tool.

* * * * *